United States Patent [19]

Vitau

[11] 4,222,245

[45] Sep. 16, 1980

[54] SETTING FOR PRECIOUS STONES OR THE LIKE AND A METHOD FOR MOUNTING PRECIOUS STONES OR THE LIKE IN A SETTING

[76] Inventor: Jean Vitau, 18 Ackerman Ave., Oradell, N.J. 07649

[21] Appl. No.: 5,369

[22] Filed: Jan. 22, 1979

[51] Int. Cl.[3] ..... A44C 17/02

[52] U.S. Cl. ..... 63/28; 29/160.6

[58] Field of Search ..... 63/28, 27, 26; 29/160.6, 10; D11/91, 92

[56] References Cited

U.S. PATENT DOCUMENTS

| | | | |
|---|---|---|---|
| D. 153,297 | 4/1949 | Kinsley | D11/92 |
| 532,824 | 1/1895 | Schill | 63/28 |
| 884,979 | 4/1908 | Fishel | 63/28 |
| 3,339,378 | 9/1967 | Chirol | 63/28 |
| 3,974,662 | 8/1976 | Avidissian | 29/160.6 X |

FOREIGN PATENT DOCUMENTS

| | | | |
|---|---|---|---|
| 2384468 | 11/1978 | France | 63/28 |
| 513052 | 12/1937 | United Kingdom | 63/28 |

*Primary Examiner*—F. Barry Shay

*Attorney, Agent, or Firm*—Auslander & Thomas

[57] ABSTRACT

A setting and a method for mounting precious stones or the like comprises providing a setting having a top surface, at least one row of at least two adjacent cavities and a connecting portion connecting each pair of adjacent cavities, each cavity configured to receive a precious stone or the like therein from the top surface with a peripheral portion of each stone extending over the associated connecting portions. The deformable enlargeable and compressible securing slots are formed at each connecting portion above the top surface of the setting and receptive of the peripheral portions of the stones. In the method, the slots are deformed to enlarge same and the stones are inserted in the cavities with the peripheral portions in the slots and the slots are compressed to secure the stones in place.

7 Claims, 9 Drawing Figures

FIG.1A
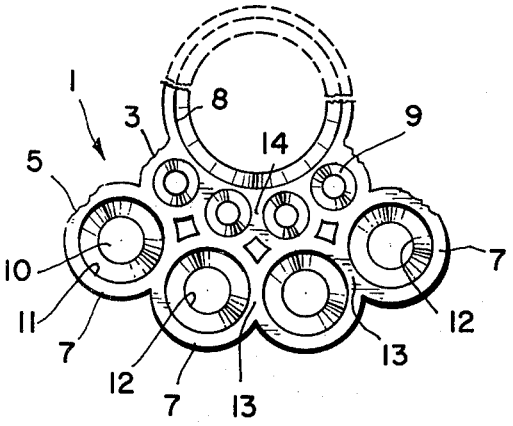
FIG.1B
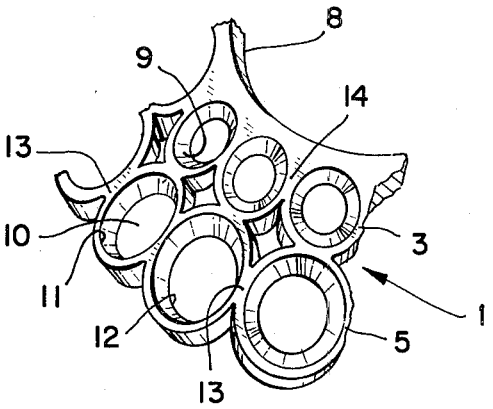
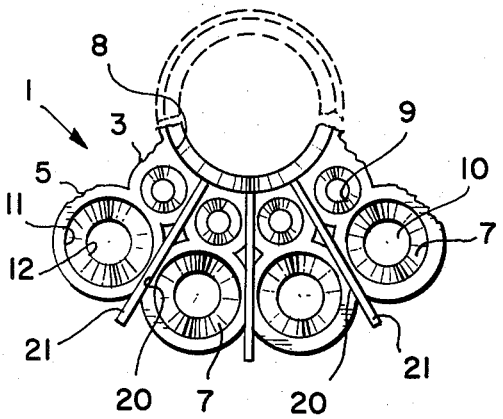
FIG. 2A
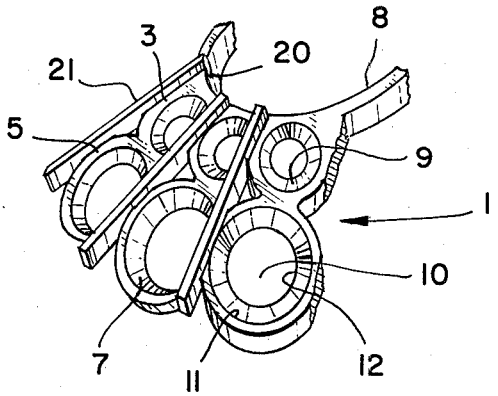
FIG.2B

FIG.3A
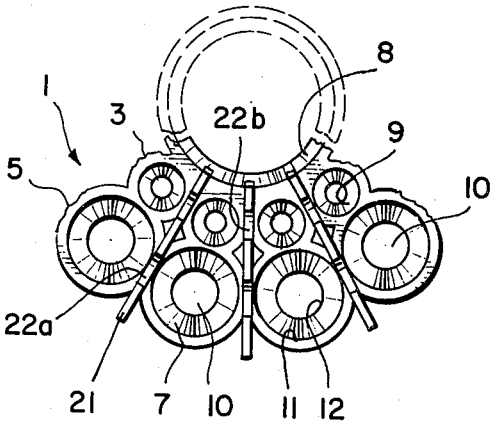
FIG.3B
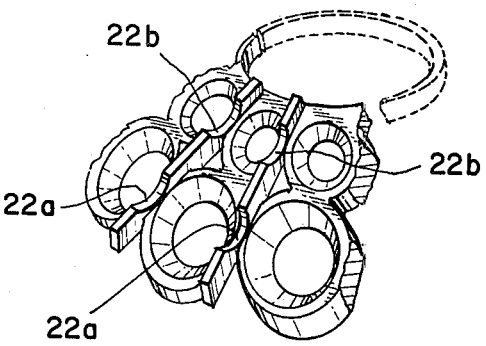
FIG.4A
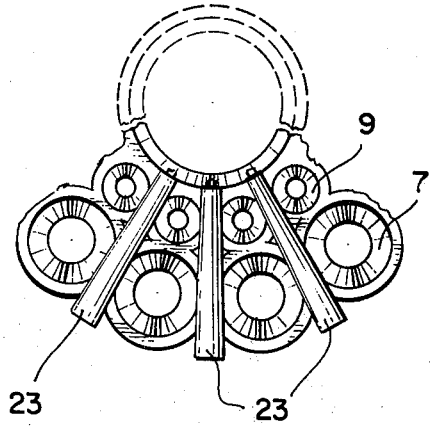
FIG.4B
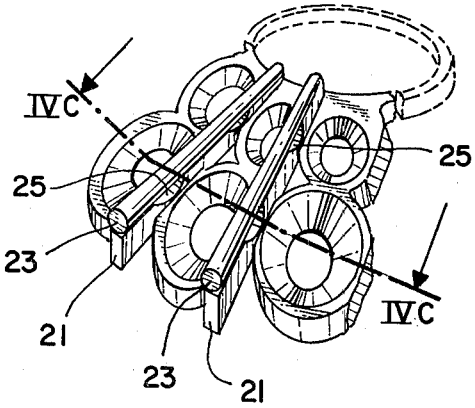
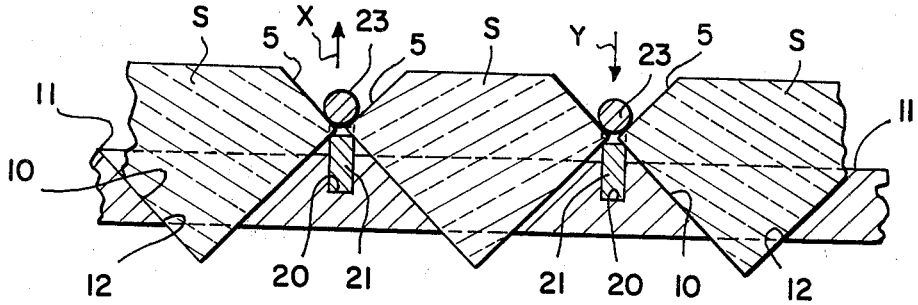
FIG.4C

SETTING FOR PRECIOUS STONES OR THE LIKE AND A METHOD FOR MOUNTING PRECIOUS STONES OR THE LIKE IN A SETTING

BACKGROUND OF THE INVENTION

The present invention relates to a setting for precious stones or the like and a method for mounting the stones and more particularly for mounting in a setting of at least one row of at least two adjacent cavities.

Stone settings are known in the prior art and which utilize the conventional prong type method for securing a stone in a cavity. This conventional art is typified in U.S. Pat. No. 1,204,916 and U.S. Pat. Nos. Des. 47,245 and 153,297.

Other settings merely use a bezel cavity therein to hold the stones such as in U.S. Pat. No. Des. 14,704.

In another type of setting, as disclosed in U.S. Pat. No. 3,339,378, a strap is utilized to maintain adjacent stones in their cavities. This setting and the process for mounting the stones, has the disadvantage of not enabling the mounting of multiple rows of adjacent stones with the necessary security.

SUMMARY OF THE INVENTION

The main object of the present invention is to provide an improved setting for stones and an improved method for mounting stones in a setting.

Another object is to overcome the disadvantages of the prior art types of settings and methods for mounting stones.

These and other objects are achieved by the setting of the present invention for precious stones or the like comprising mounting means having a top surface and comprising at least one row of at least two adjacent cavities and a connecting portion connecting each pair of adjacent cavities, each cavity configured to receive a precious stone or the like therein from the top surface with a peripheral portion of each stone extending over the associated connecting portions and securing means defining securing slots at each connecting portion and above the top surface of the mounting means for releasably receiving the peripheral portions of the stones to be mounted to secure same in position in their cavities.

In a preferred embodiment, the securing means comprises manually deformable means, upwardly deformable to enlarge each securing slot to effect insertion of the peripheral portion of the associated stone and downwardly reformable to compress each securing slot to fix the stone in position and a supporting member for each connecting portion, means fixedly mounting each supporting member in the associated connecting portion with a portion thereof extending outwardly of the top surface, wherein each supporting member comprises at least one declivity in the outwardly extending portion configured to receive and support the peripheral portions of the associated stones. The deformable means preferably comprises a deformable member fixedly mounted on each supporting member and configured to overlie the declivities therein to define the securing slots in cooperation with the declivities.

The means mounting each supporting member preferably comprises a mounting groove in each connecting portion into which the associated supporting member is partially received and soldered for fixing the supporting member in position.

In a particularly advantageous embodiment of the invention, the mounting means comprises at least two concentric rows of radially aligned cavities having a plurality of sets of radially aligned connecting portions and wherein the means mounting the supporting members comprises a plurality of aligned radial grooves in the connecting portions and further comprising a plurality of supporting members each positioned in one radial groove and extends through each connecting portion of the associated set and a plurality of deformable members, each connected to one supporting member.

The method for mounting precious stones or the like according to the present invention comprises providing a setting having a top surface, at least one row of at least two adjacent cavities and a connecting portion connecting each pair of adjacent cavities, each cavity configured to receive a precious stone or the like therein from the top surface with a peripheral portion of each stone extending over the associated connecting portions, forming manually deformably enlargeable and compressible securing slots at each connecting portion above the top surface of the setting and receptive of the peripheral portions of the stones, deforming the slots to enlarge same and inserting the stones in the cavities with the peripheral portions in the slots and reforming the slots to compress same to secure the stones in place.

Preferably, the step of forming the slots comprises fixing a supporting member in each connecting portion with a portion thereof extending outwardly from the top surface, forming at least one declivity in the outwardly extending portion of each supporting member, each declivity configured to receive and support the peripheral portion of the associated stone and fixing a deformable member on each supporting member configured to overlie the declivities therein. The step of fixing the supporting members preferably comprises making a saw cut in each connecting portion, partially inserting each supporting member in one saw cut and soldering each support member to the setting.

In a particularly advantageous embodiment of the method, a setting is provided having at least two concentric rows of radially aligned cavities having a plurality of sets of radially aligned connecting portions and wherein the slots are formed by making a radial saw cut in each set of radially aligned connecting portions, inserting a supporting member in each saw cut configured to extend through each connecting portion of the set and to extend outwardly from the top surface of the setting, forming a declivity in each supporting member at each connecting portion, each declivity configured to receive and support the peripheral portion of the associated stone, fixing a deformable member on each supporting member and configured overlie each declivity therein.

Although such novel feature or features believed to be characteristic of the invention are pointed out in the claims, the invention and the manner in which it may be carried out, may be further understood by reference to the description following and the accompanying drawings.

Numerous other features and advantages of the present invention will become apparent from the following specification when read in connection with the accompanying drawings wherein:

BRIEF DESCRIPTION OF THE DRAWINGS

FIGS. 1A and 1B are top and perspective views respectively of a setting in a first stage of the method of the present invention;

FIGS. 2A and 2B are top and perspective views of a setting in a second stage of the method of the present invention;

FIGS. 3A and 3B are top and perspective views of a setting in a third stage of the method of the present invention;

FIGS. 4A and 4B are top and perspective views of a setting in a fourth stage of the method of the present invention; and FIG. 4C is a sectional view of FIG. 4B along line IVc—IVc of the setting of the present invention with stones in place.

DETAILED DESCRIPTION OF THE INVENTION

Referring now to the figures in greater detail, where like reference numbers denote like parts in the various figures.

Referring now to FIGS. 1A and 1B, a setting 1 composed of a precious metal or the like, includes two rows 3 and 5 of frustoconical bezels 9 and 7 respectively defining cavities 10. The rows 3,5 are shown in radial alignment around a center bezel 8. However, this is shown only for the purposes of illustrating the present invention.

The bezels 7 and 9 each include upper and lower stone mounting edges 11 and 12. It will be apparent that the bezels can have other traditional stone holding shapes and that the edges are optional and the settings may alternatively comprise any cavity of the proper configuration for the stones to be used.

Between each pair of adjacent cavities 10 is situated a connecting portion 13,14. The width of the connecting portion is determined by the amount of overlap by the peripheral portions of the stones to be mounted (FIG. 4C).

The mounting of the stone is carried out by first mounting supporting members 21 in mounting grooves 20 as shown in FIGS. 2A and 2B. This is effected in a preferred embodiment by making precision radial saw cuts to form the grooves 20. The grooves 20 can also be formed by any conventional metal working methods. The cuts are so configured that the members 21, which are preferably rectangular as shown, are partially inserted therein with a portion extending upwardly from the top surface of the setting 1. The supporting members 21, preferably composed of precious metal, are then soldered in place to hold them firmly in a conventional manner.

Turning now to FIGS. 3A and 3B, declivities **22*a* and 22*b* are formed in the outwardly extending portions of the members 21. The declivities 22*a*,22*b* are formed at the connecting portions 13,14 by cutting or grinding and are configured to receive and support the peripheral portions 5, of stones S (FIG. 4C) so that they rest in the declivities when placed in the cavities 10**.

As shown in FIGS. 4A, 4B and 4C, thereafter deformable rods 23 are disposed on the tops of the supporting members and are configured to overlie the declivities **22*a*,22*b*. The deformable rods 23 are preferably of cylindrical shape but can alternatively have a flat, oval or rectangular cross-section. The rods 23 are composed of a deformable material, preferably in a precious metal which has the same appearance as the setting 1. The rods 23 are soldered in place over the members 21 and in conjunction with the declivities 22*a*,22*b* therein, forming securing slots 25**.

In order to mount a stone in the setting thus formed, the rod 23 is deformed upwardly as shown by arrow x in FIG. 4C, so that the slot 25 is enlarged. The stones S are then placed in position in cavities 10 with their peripheral portions S overlying the connecting portions 13,14 and resting on declivities **22*a*,22*b*. Thereafter, the rods 23 are reformed downwardly (arrow Y) compressing the slots 25** and securing the stones S in position.

It is evident that those skilled in the art may now make numerous modifications to the specific embodiments described herein without departing from the inventive concept.

The terms and expressions which are employed are used as terms of description, it is recognized, though, that various modifications are possible.

It is also understood that the following claims are intended to cover all of the generic and specific features of the invention herein described, and all statements of the scope of the invention which, as a matter of language, might fall therebetween.

Having described certain forms of the invention in some detail, what is claimed is:

1. A setting for precious stones or the like comprising: mounting means having a top surface and comprising at least one row of at least two adjacent cavities and a connection portion connecting each pair of adjacent cavities, each cavity configured to receive a precious stone or the like therein from the top surface with a peripheral portion of each stone extending over the associated connecting portion, and securing means defining securing slots at each connecting portion and above the top surface of the mounting means for receiving the peripheral portion of the stones to be mounted to secure same in position in their cavities, said securing means comprising manually deformable means, upwardly deformable to enlarge each securing slot to effect insertion of the peripheral portion of the associated stone and downwardly reformable to compress each securing slot to fix the stone in position, said securing means further comprising a supporting member for each connecting portion and means fixedly mounting each supporting member in the associated connecting portion with a portion thereof extending outwardly of the top surface whereby each supporting member includes at least one declivity in the outwardly extending portion configured to receive and support the peripheral portions of the associated stones.

2. The setting according to claim 1, wherein the deformable means comprises a deformable member fixedly mounted on each supporting member and configured to overlie the declivities therein to define the securing slots in cooperation with the declivities.

3. The setting according to claim 2, wherein the means mounting each supporting member comprises a mounting groove in each connecting portion into which the associated supporting member is partially received and solder for fixing the supporting member in position.

4. The setting according to claim 2, wherein the mounting means comprises at least two concentric rows of radially aligned cavities having a plurality of sets of radially aligned connecting portions and wherein the means mounting the supporting members comprises a plurality of aligned radial grooves in the connecting portions and further comprises a plurality of supporting members each positioned in one radial groove and extending through each connecting portion of the associated set and a plurality of deformable members, each connected to one supporting member.

5. A method for mounting precious stones or the like, comprising the steps of: providing a setting having a top surface, at least one row of at least two adjacent cavities and a connection portion connecting each pair of adjacent cavities, each cavity configured to receive a precious stone or the like therein from the top surface with a peripheral portion of each stone extending over the associated connecting portions; forming a deformable enlargeable and compressible securing slot at each connecting portion above the top surface of the setting and receptive of the peripheral portions of the stones, said step of forming the slots comprising; fixing a supporting member in each connecting portion with a portion thereof extending outwardly from the top surface, forming a least one declivity in the outwardly extending portion of each supporting member, each declivity configured to receive and support the peripheral portion of the associated stone and fixing a deformable member on each supporting member configured to overlie the declivities therein; deforming the slots to enlarge same and inserting the stones in the cavities with the peripheral portions in the slots; and reforming the slots to compress same to secure the stone in place.

6. The method according to claim 5, wherein the step of fixing the supporting members comprises making a saw cut in each connecting portion, partially inserting each supporting member in one saw cut and soldering each supporting member to the setting.

7. The method according to claim 5, further comprising providing a setting having at least two concentric rows of radially aligned cavities having a plurality of sets of radially aligned connecting portions and wherein the slots are formed by making a radial saw cut in each set of radially aligned connecting portions, inserting a supporting member in each saw cut configured to extend through each connecting portion of the set and to extend outwardly from the top surface of the setting, forming a declivity in each supporting member at each connecting portion, each declivity configured to receive and support the peripheral potions of the associated stones, fixing a deformable member on each supporting member and configured to overlie each declivity therein.

* * * * *